US005340415A

United States Patent [19]

Koike et al.

[11] Patent Number: 5,340,415

[45] Date of Patent: Aug. 23, 1994

[54] FERRITIC STAINLESS STEEL PLATES AND FOILS AND METHOD FOR THEIR PRODUCTION

[75] Inventors: Masao Koike, Ibaraki; Akihito Yamagishi, Amagasaki; Katsuhiko Maruyama, Muika; Shusuke Kakuchi, Amagasaki, all of Japan

[73] Assignee: Sumitomo Metal Industries, Ltd., Osaka, Japan

[21] Appl. No.: 69,731

[22] Filed: Jun. 1, 1993

[30] Foreign Application Priority Data

Jun. 1, 1992 [JP] Japan ..... 4-140637
Sep. 30, 1992 [JP] Japan ..... 4-261818

[51] Int. Cl.[5] ..... C22C 38/28; C22C 38/06; C21D 8/00

[52] U.S. Cl. ..... 148/325; 148/602; 148/609; 428/607; 72/700

[58] Field of Search ..... 148/325, 602, 609; 420/40; 428/607; 72/700

[56] References Cited

U.S. PATENT DOCUMENTS 4,204,862 5/1980 Kado et al. ..... 420/40
4,360,381 11/1982 Tarutani et al. .
4,374,683 2/1983 Koike et al. .
4,484,956 11/1984 Shida et al. ..... 148/609
4,799,972 1/1989 Masuyama et al. .
4,957,701 9/1990 Masuyama et al. .

FOREIGN PATENT DOCUMENTS

0246939A3 11/1987 European Pat. Off. .
0370645A1 5/1990 European Pat. Off. .
0387670A1 9/1990 European Pat. Off. .
0516267A1 12/1992 European Pat. Off. .
60-228616 11/1985 Japan .
833446 4/1960 United Kingdom .

*Primary Examiner*—Deborah Yee
*Attorney, Agent, or Firm*—Burns, Doane, Swecker & Mathis

[57] ABSTRACT

A heat-resistant ferritic stainless steel plate or foil having improved toughness as well as workability is disclosed, which consists essentially of:

C: not larger than 0.020%,
N: not larger than 0.020%, wherein,

C(%)+N(%): not larger than 0.030%,
Si: not larger than 1.0%,
Mn: not larger than 1.0%, or one or more of Si: larger than 1.0% but not larger than 5.0% and Mn: larger than 1.0% but not larger than 2.0%,
Cr: 9.0–35.0%,
Al: 3.0–8.0%,
Y: 0.010–0.10%,
Ti: 0.010–0.10%,
Mo: 0–5.0%,
Fe and incidental impurities: balance, and which is manufactured by cooling the hot-rolled steel plate at a cooling rate of 20° C./sec- or higher immediately after hot rolling, coiling the hot-rolled steel plate at a temperature of 400° C. or lower, and preferably cold rolling the resulting hot-rolled steel plate until the thickness thereof reaches 50 micrometers or less, and applying Al vapor deposition to both sides of the thus-obtained foil to a thickness of 0.2–4.0 micrometers.

19 Claims, 2 Drawing Sheets

FERRITIC STAINLESS STEEL PLATES AND FOILS AND METHOD FOR THEIR PRODUCTION

BACKGROUND OF THE INVENTION

The present invention relates to ferritic stainless steel plates and foils with improved resistance to oxidation and a process for their manufacture.

Recently, an Fe-Cr-Al base alloy has been widely used as a superior heat-resistant material in the manufacture of heating stoves and motor vehicle exhaust gas converters. In particular, a stainless steel foil having improved resistance to impact has been used in place of conventional ceramics as a catalyst carrier for use in exhaust gas converters of motor vehicles. As service conditions are becoming more and more severe, further improvement in heat resistant properties is required.

It has been known that heat resistance of Fe-Cr-Al alloys can be markedly improved by the addition of Y. However, it is also true that the addition of Y degrades toughness of a hot-rolled plate of an Fe-Cr-Al base alloy so markedly that the occurrence of troubles such as cracking and rupture of steel is inevitable during uncoiling or cold rolling.

In order to avoid such a degradation in toughness, Japanese Patent Unexamined Laid-Open specification No. 60-228616/1985 proposes to rapidly cool a steel plate with a reduced content of C and N at a cooling rate of 10° C./sec or larger and to coil it at a temperature of 450° C. or lower. However, even when such a process is applied to an Fe-Cr-Al base alloy containing Y, a satisfactory level of toughness cannot be attained.

Thus, the prevailing method at present comprises carrying out warm rolling after heating a hot-rolled plate to 100°–400° C., and reductions in working efficiency and yield are inevitable, resulting in an increase in manufacturing costs.

When the above type of alloy is used to manufacture an exhaust gas converter for automobiles, an extremely thin foil having a thickness of 50 micrometers or smaller after rolling is assembled to form a honeycomb structure. Since the thickness of the foil compared with that of a ceramics honeycomb is very small, the resistance to flow through the structure is reduced due to a reduction in a sectional area of the honeycomb structure, resulting in an improvement in engine performance.

It is necessary to heat a catalyst in start-up procedures. The start-up procedures require a substantial length of time and the catalyst does not work until it is heated to a given temperature. On the other hand, the thinner the thickness of the foil, the smaller the heat content of the honeycomb structure. It is possible to shorten the length of time to reach the given temperature by making the foil thinner.

In contrast, the resistance to oxidation is markedly degraded as the thickness of a foil decreases. The Al content of a foil also has an important influence on the oxidation resistance. The larger the Al content, the more the oxidation resistance is improved. However, when the content of Al is increased beyond a certain point, the producibility and workability of the steel plate are impaired to make it difficult to mass produce foils in an economical way.

SUMMARY OF THE INVENTION

An object of the present invention is to provide a ferritic stainless steel hot-rolled plate of an Y-added Fe-Cr-Al alloy having improved toughness as well as workability, making it possible to carry out cold rolling with an improvement in manufacturing yield and working efficiency as well as resistance to oxidation in the form of a foil.

Another object of the present invention is to provide a process for manufacturing the ferritic stainless steel hot-rolled plate.

Still another object of the present invention is to provide a foil having improved resistance to oxidation and a process for manufacturing it.

The present invention is a hot-rolled plate of a ferritic stainless steel having improved toughness as well as workability, which consists essentially of:

C: not larger than 0.020%,
Si: not larger than 1.0%,
Mn: not larger than 1.0%,
N: not larger than 0.020%,
wherein,
C(%) +N(%): not larger than 0.030%,
Cr: 9.0–35.0%,
Al: 3.0–8.0%,
Y: 0.010–0.10%,
Ti: 0.010–0.10%,
Mo: 0–5.0%,
or
C: not larger than 0,020%,
N: not larger than 0.020%,
wherein,
C(%)+N(%): not larger than 0,030%,
Cr: 9.0–35.0%,
Al: 3.0–8.0%,
Y: 0.010–0.10%,
Ti: 0.010–0.10%,
one or more of Si: larger than 1.0% but not larger than 5.0% and Mn: larger than 1.0% but not larger than 2.0%,
Mo: 0–5.0%,
Fe and incidental impurities: balance.

According to another aspect, the present invention is a process for manufacturing a hot-rolled plate of a ferritic stainless steel, which comprises the steps of hot rolling a ferritic stainless steel having the above-mentioned steel composition, cooling the hot-rolled steel plate at a cooling rate of 20° C./sec. or higher immediately after hot rolling, and coiling the hot-rolled steel plate at a temperature of 400° C. or lower.

According to still another aspect, the present invention a process for manufacturing a foil of a ferritic stainless steel which consists essentially of:

C: not larger than 0.020%,
Si: not larger than 1.0%,
Mn: not larger than 1.0%,
N: not larger than 0.020%,
wherein,
C(%)+N(%): not larger than 0.030%,
Cr: 9.0–35.0%,
Al: 3.0–8.0%,
Y: 0.010–0.10%,
Ti: 0.010–0.10%,
Mo: 0–5.0%,
or
C: not larger than 0.020%,
N: not larger than 0.020%,
wherein,
C(%)+N(%): not larger than 0.030%,
Cr: 9.0–35.0%,
Al: 3.0–8.0%, Y: 0.010–0.10%,
Ti: 0.010–0.10%,
one or more of Si: larger than 1.0% but not larger than 5.0%, and Mn: larger than 1.0% but not larger than 2.0%,
Mo: 0–5.0%,
Fe and incidental impurities: balance,
the process comprising cooling the hot-rolled steel plate at a cooling rate of 20° C./sec. or higher immediately after hot rolling, coiling the hot-rolled steel plate at a temperature of 400° C. or lower, cold rolling or warm rolling the resulting hot-rolled steel plate until the thickness thereof reaches 50 micrometers or less, and applying Al vapor deposition to both sides of the thus-obtained foil to a thickness of 0.2–4.0 micrometers.

According to still another aspect, the present invention is a ferritic stainless steel foil of the alloy composition mentioned above having Al vapor deposition performed on both sides of it, the thickness of the deposition being 0.2–4.0 micrometers.

DESCRIPTION OF THE PREFERRED EMBODIMENTS

Figure 1:
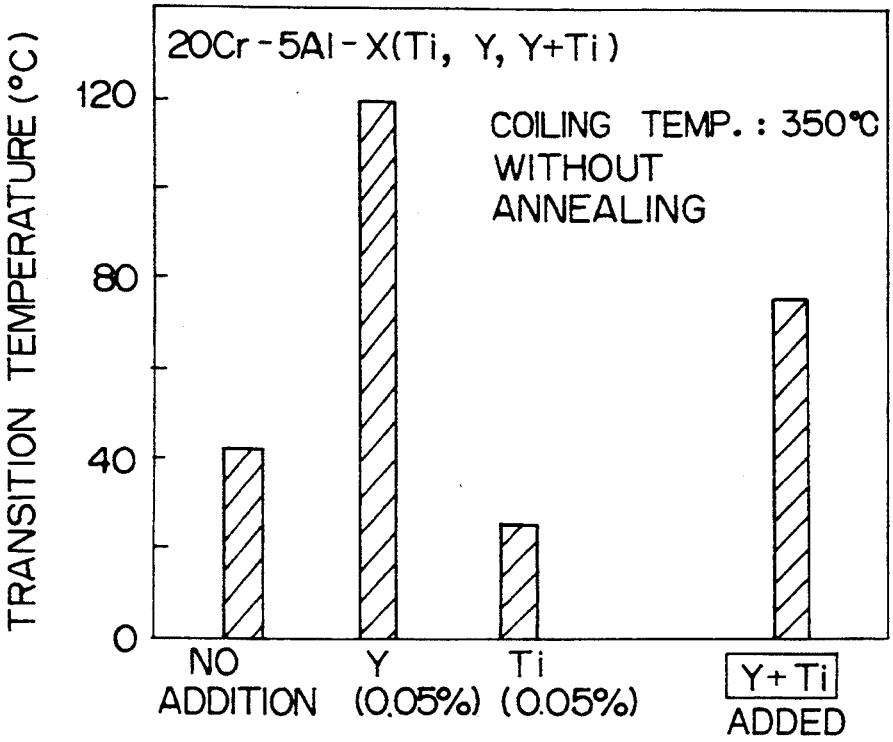
FIG. 1 is a graph showing the influence of the addition of Y and/or Ti on the fracture appearance transition temperature of a hot-rolled plate of an Fe-Cr-Al alloy.

The reasons why the alloy composition, the manufacturing conditions including cooling rate, coiling temperature, and thickness of an aluminum vapor deposition have the abovedescribed values will be described. The term "%", unless otherwise indicated, means percent by weight, i.e., "wt %". C, N:

The presence of carbon (C) and nitrogen (N) each in an amount of more than 0.020% or in a combined total amount of more than 0.030% impairs the toughness of a hot rolled steel. Thus, the content of each of C and N is restricted to not more than 0.020%, and the total amount of C and N is restricted to not more than 0.030%. Preferably, the C content is not more than 0.010% and the N content is not more than 0.010%. Cr:

Chromium (Cr) is the most important element to ensure resistance to oxidation as well as corrosion. The incorporation of Cr in an amount of smaller than 9.0% does not achieve a satisfactory level of these properties. On the other hand, when the Cr content is over 35.0%, toughness and workability (ductility) under cold conditions of a hot-rolled steel are degraded markedly. Accordingly, the Cr content is restricted to 9.0–35.0%, and preferably to 18–25%. Al:

Aluminum (Al) is effective for improving the resistance to oxidation of a ferritic stainless steel. However, according to the present invention, the incorporation of less than 3.0% of Al is not enough to further improve the resistance to oxidation. On the other hand, when more than 8.0% of Al is added, toughness and workability under cold conditions are markedly degraded. In the present invention the Al content is restricted to 3.0–8.0%, and preferably to 3.0–6.0%. Y:

The addition of Y is effective for improving the oxidation resistance remarkably. The effectiveness of Y is not sufficient when the content of Y is less than 0.010%, but when Y is added in an amount of more than 0.10%, hot workability is degraded remarkably. According to the present invention the Y content is restricted to 0.010–0.10%. Ti:

Titanium (Ti) easily forms a nitride and carbide to reduce the amount of carbon and nitrogen in solid solution with a resulting improvement in toughness of hot rolled steel. For this purpose, at least 0.010% of Ti is added. When Ti is added in an amount of more than 0.10%, a degradation in cold workability is serious. Accordingly, the Ti content is restricted to 0.010–0.10%.

Synergistic Effect of the addition of Y+Ti:

When only Y is added to an Fe-Cr-Al base alloy, the resistance to oxidation can be markedly improved, but the toughness of a hot-rolled plate of this alloy is simultaneously degraded to a great extent. In contrast, when Ti is added, toughness can be improved markedly.

Unexpectedly, however, when Y as well as Ti are added, not only the oxidation resistance but also the toughness can be improved to such a level that it is possible to carry out warm rolling after heating by dipping the plate into warm water. Si, Mn:

These elements are optional- Usually Si and Mn are present as impurities each in an amount of not larger than 1.0%. However, when they are intentionally added as alloying elements, larger than 1.0% of each of Si and Mn is added.

Thus, when these elements are added intentionally, Si and Mn are added so as to further improve oxidation resistance at high temperatures. According to the present invention, at least one of 1.0–5.0% of Si, and 1.0–2.0% of Mn is added optionally.

Mo:

Mo is an optional element, which is effective for further improving oxidation resistance when Mo is added in an amount of 0.5–5.0%.

According to the present invention, a ferritic stainless steel having the steel composition defined above is hot rolled to provide a hot-rolled steel plate. The conditions for hot rolling are not restricted to specific ones, but under usual conditions, the heating temperature may be 1100°–1250° C. and the finishing temperature may be 800°–1000° C.

Cooling Rate:

When a hot-rolled plate is cooled at a cooling rate of lower than 20° C./sec., i.e., smaller than 20° C./sec- after finishing hot rolling, the fracture appearance transition temperature of the hot-rolled plate is raised, and it is expected that troubles such as generation of cracking and fracture occur during uncoiling and cold or warm rolling of the hot-rolled plate. Thus, it is necessary to adjust a cooling rate after hot rolling to not smaller than 20° C./sec- by means of water spray, for example. A preferable cooling rate is 20°–30° C./sec.

Coiling Temperature:

When the coiling temperature is higher than 400° C., even if the cooling rate after hot rolling is adjusted to 20° C./sec or higher, a hot-rolled plate is brittle due to a heat cycle to be applied to the plate during slow cooling after coiling.

There is no specific lower limit on the coiling temperature, but usually when it is lower than 250° C., deformation resistance of the hot-rolled plate increases to such a high level that it is rather difficult to coil the plate. Thus, it is preferable to coil a hot-rolled plate at a temperature of higher than 250° C.

Influence of Annealing:

According to the present invention, a hot-rolled steel plate can be subjected to warm rolling directly to shape it to predetermined sizes. Alternatively, the hot-rolled plate can be subjected to cold rolling after annealing.

When cold rolling is to be performed on the hot-rolled plate, it is preferable to apply annealing before cold rolling. It was found by the inventors of the present invention that there is a relationship between the annealing temperature and the fracture appearance transition temperature for a hot-rolled steel plate, and it is desirable that the annealing be carried out at a temperature of not lower than 900° C. However, when the annealing temperature is over 1050° C., coarsening of crystal grains occurs, resulting in the possibility of a marked reduction in toughness. In order to soften the steel, therefore, it is preferable that annealing be carried out at 900°-1050° C.

Thickness of Al Coating:

According to a further embodiment of the present invention, Al may be vapor deposited on a foil which is produced by a process of the present invention in order to further improve the oxidation resistance. The thickness of the foil of the present invention is not restricted to a specific one, but it is usually 50 micrometers or less.

On the other hand, the thickness of the Al vapor deposition is restricted to 0.2–4.0 micrometers. When the thickness of the Al vapor deposition is smaller than 0.2 micrometer, the purpose of the Al deposition cannot be achieved. On the other hand, when the thickness is over 4.0 micrometers, an oxide film which has been formed at high temperatures will be stripped off in the course of cooling.

When the foil of the present invention is used for making an exhaust gas converter for motor vehicles, a catalyst is coated on the foil. If the oxide film on the foil is separated from the substrate, i.e., the foil, the catalyst placed on it is also stripped off.

The Al vapor deposition can be achieved by conventional processes, such as ion plating, sputtering, and resistance heating vapor deposition. Of these, ion plating is preferable.

Furthermore, an aluminum alloy, in place of pure aluminum, can also be used as a vaporized material.

The present invention will be further described in conjunction with working examples, which are presented merely for illustrative purposes.

EXAMPLE 1

Ferritic stainless steels having alloy compositions shown in Table 1 were prepared by a vacuum melting process.

Each steel was hot rolled and coiled under conditions shown in Table 2 to prepare a hot-rolled steel plate having a thickness of 4.5 mm.

The properties of the resulting hot-rolled steel plate were evaluated.

Toughness was evaluated in terms of transition temperature, which was determined by an impact test. The test was carried out using a V-notched Charpy impact test specimen 2.5 mm thick, which was cut from a hot-rolled plate in the direction perpendicular to a rolling direction in accordance with JIS standards. When the transition temperature is 100° C. or less, it is possible to apply warm rolling to the hot-rolled steel plate after soaking it in warm water.

FIG. 1 is a graph showing the variation of the fracture appearance transition temperature in accordance with the alloying elements added to an Fe-Cr-Al alloy.

Namely, Steels A, K, L, and M were heated to 1200° C., hot rolled with a finishing temperature of 830° C., cooled at a cooling rate of 20° C./sec., and coiled at 350° C. The fracture appearance transition temperature of each of the resulting hot-rolled steel plates was determined.

As is apparent from the graph shown in FIG. 1, addition of Y by itself to an Fe-Cr-Al alloy (Steel M) raises the fracture appearance transition temperature markedly, and this means that toughness is seriously impaired as compared with those of the case (Steel K) in which Y and Ti are not added. On the other hand, simultaneous addition of Y and Ti to the Fe-Cr-Al alloy (Steel A) achieves a transition temperature of 75° C., which is much higher than that achieved when Ti by itself is added (Steel L), but improvement in toughness achieved by the addition of Y and Ti is remarkable compared with that achieved by the addition of Y alone. Such an improvement in toughness means that it is possible to carry out warm rolling of a hot-rolled steel plate after heating it by passing it through warm water.

Figure 2:
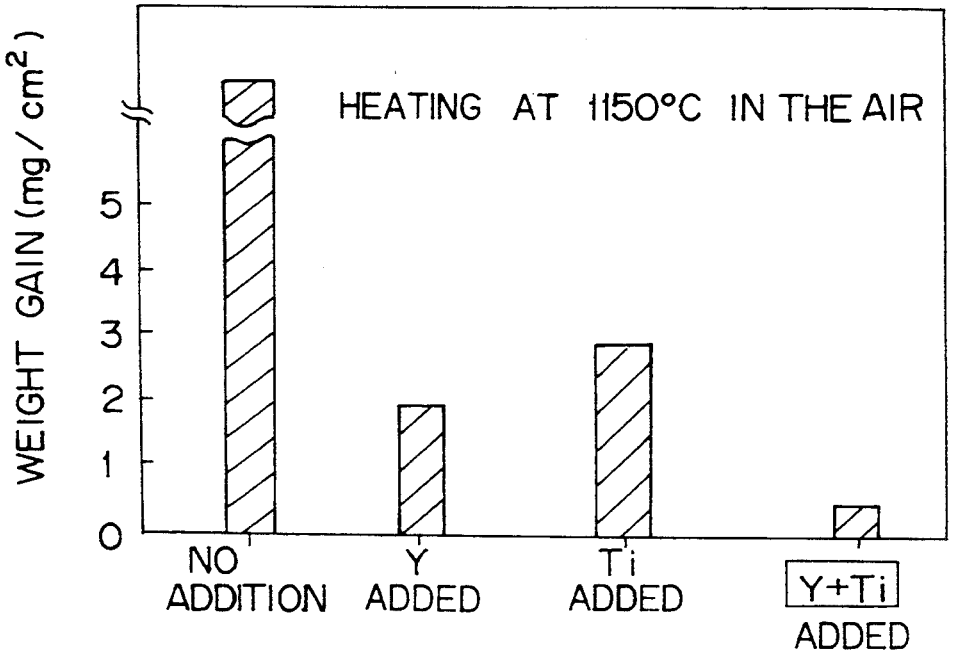
FIG. 2 is a graph showing the influence of the addition of Y and/or Ti on the heat resistance of a hot-rolled plate of an Fe-Cr-Al alloy.

FIG. 2 shows improvements in heat resistance achieved by the addition of Y and/or Ti. The synergistic effect on heat resistance of a simultaneous addition of Y and Ti is remarkable.

Figure 3:
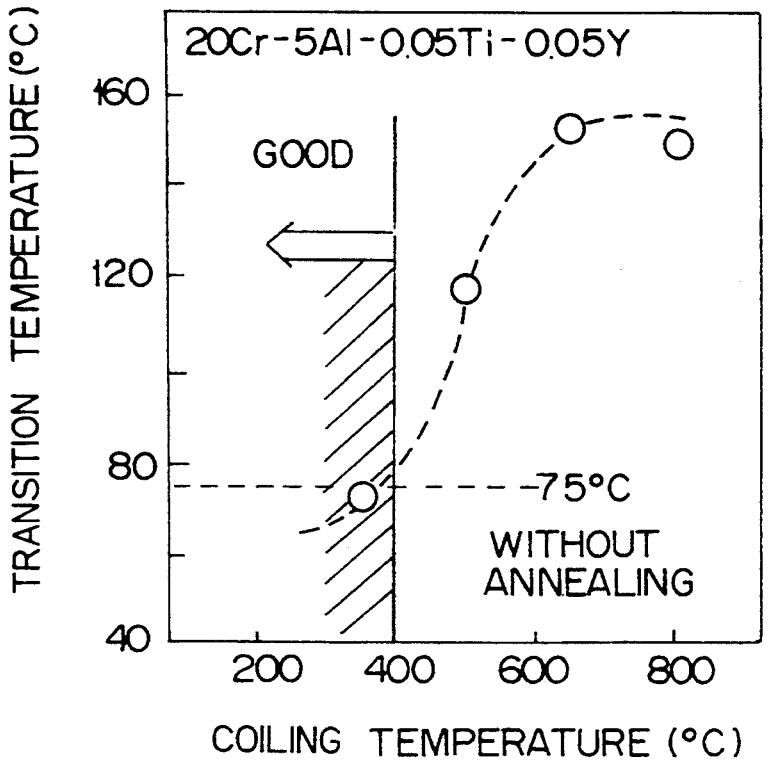
FIG. 3 is a graph showing the influence of coiling temperature on the fracture appearance transition temperature of a hot-rolled plate of an Fe-Cr-Al alloy.

FIG. 3 is a graph showing the relationship between a coiling temperature and a fracture appearance transition temperature for the Fe-Cr-Al alloy containing both Y and Ti.

Namely, Steel A was heated to 1200° C., hot rolled with a finishing temperature of 830° C., cooled at a cooling rate of 20° C./sec., and coiled at the indicated temperatures. The fracture appearance transition temperature of each of the resulting hot-rolled steel plates was determined with respect to the coiling temperatures.

As is apparent from FIG. 3, the fracture appearance transition temperature goes up beyond 100° C. when the coiling temperature is 800°-500° C. However, when the coiling temperature is 400° C. or less, the transition temperature is reduced to 75° C. or below, and this means that it is possible to carry out warm rolling.

Next, steels having the alloy compositions shown in Table 1 were hot rolled under conditions shown in Table 2, and the resulting hot-rolled steels were determined with respect to transition temperature in the same manner as before. Test results are shown in Table 2.

It is noted from the data in Table 2 that a transition temperature of 100° C. or below can be achieved so long as the steels are manufactured in accordance with the present invention.

The relationship between an annealing temperature and fracture appearance transition temperature was determined for Steel A to which Y and Ti were added. Test results are shown in Table 3.

As is apparent from Table 3, the transition temperatures were over 100° C. when the annealing temperatures were 700° C. and 800° C. However, when the annealing was not carried out or the annealing temperature was 900° C., the transition temperature was 75° C. This means that if annealing is performed, it is necessary for the annealing temperature to be 900° C. or higher. However, when the temperature is over 1050° C., coarsening of crystal grains is inevitable, possibly resulting in a degradation in toughness. It is therefore desirable that annealing be carried out at a temperature of 900°–1050° C. for the purpose of effecting softening of the steel.

As is apparent from the above, a hot-rolled steel plate produced in accordance with the present invention has a markedly improved level of toughness, so that it is possible to apply warm rolling after heating in warm water and to apply cold rolling thereafter.

EXAMPLE 2

The hot-rolled steel plate of Steel A which was prepared in Example 1 was then subjected to warm rolling after heating the plate by passing it through warm water. After warm rolling cold rolling and annealing were repeated until a foil coil having a thickness of 40 micrometers and a width of 300 mm was obtained.

A specimen (200 mm×200 mm) was cut from this foil. The specimen was placed within a vacuum apparatus at a vacuum of $10^{-4}$–$10^{-5}$ Torr, and ion plating was carried out on both sides of the specimen to give an Al vapor deposition film having a thickness of 0.1, 0.2, 1, 2, 3, 4, or 5 micrometers.

From the aluminum-deposited foil, specimens measuring 20 mm×30 mm were cut and subjected to an oxidation resisting test at 1150° C. for 350 hours in the air. At given time intervals, the specimens were taken out to be weighed.

Test results are shown in Table 4, in which the symbol "0" indicates a weight gain during oxidation of smaller than 1 mg/cm$^2$, the symbol "Δ" indicates an oxidation gain of more than 1 mg/cm$^2$ and occurrence of a partial abnormal oxidation, and the symbol "X" indicates that the foil was totally oxidized. The symbol "  " indicates that the oxidation gain was less than 1 mg/cm$^2$, but an oxide film on the foil was peeled-off, A bare specimen, i,e., a specimen free of an Al vapor deposition could stand for 96 hours, but after 120 hours it was fully oxidized. A specimen having an Al vapor deposition film 0.1 micrometer thick was partially oxidized after 120 hours, and after 144 hours it was totally oxidized. Thus, it is noted that an Al film having a thickness of 0.1 micrometer or thinner is of no use.

A specimen having an Al vapor deposition 0.2 micrometer thick could stand for 240 hours before partial oxidation occurred. This means that the oxidation resistance of this specimen was two times superior to that of a bare specimen.

Furthermore, a specimen having a vapor deposition film with a thickness of 1 micrometer or larger exhibited further improved resistance to oxidation, and particularly specimens having a film 2–4 micrometers thick were totally free from abnormal oxidation even after 350 hours.

However, when the thickness of the Al coating was 5 micrometers, it suffered from a separation of an oxide film after 96 hours.

TABLE 1

| Steel | Chemical Composition (% by weight) C | Si | Mn | P | S | Cr | Ti | Y | Al | N | Others | Remarks |
|---|---|---|---|---|---|---|---|---|---|---|---|---|
| A | 0.007 | 0.30 | 0.42 | 0.020 | 0.001 | 20.29 | 0.051 | 0.060 | 4.90 | 0.0079 | | This |
| B | 0.006 | 0.31 | 0.42 | 0.015 | 0.001 | 21.35 | 0.048 | 0.063 | 3.11 | 0.0080 | | Invention |
| C | 0.007 | 0.34 | 0.43 | 0.018 | 0.001 | 19.85 | 0.054 | 0.040 | 6.79 | 0.0066 | | |
| D | 0.004 | 0.32 | 0.44 | 0.021 | 0.001 | 17.11 | 0.053 | 0.070 | 4.99 | 0.0056 | | |
| E | 0.006 | 0.31 | 0.42 | 0.020 | 0.001 | 24.32 | 0.045 | 0.059 | 3.20 | 0.0079 | | |
| F | 0.006 | 0.30 | 0.43 | 0.020 | 0.001 | 16.67 | 0.039 | 0.061 | 6.93 | 0.0086 | | |
| G | 0.006 | 0.30 | 0.43 | 0.019 | 0.001 | 19.97 | 0.016 | 0.020 | 5.01 | 0.0065 | | |
| H | 0.007 | 0.31 | 0.45 | 0.024 | 0.001 | 25.06 | 0.013 | 0.019 | 4.88 | 0.0064 | | |
| I | 0.008 | 0.30 | 0.40 | 0.025 | 0.001 | 16.81 | 0.054 | 0.056 | 6.92 | 0.0073 | | |
| J | 0.005 | 0.32 | 0.41 | 0.020 | 0.001 | 20.14 | 0.079 | 0.073 | 4.76 | 0.0083 | | |
| K | 0.006 | 0.31 | 0.42 | 0.015 | 0.002 | 20.06 | 0.003* | <0.01* | 4.77 | 0.0079 | | Comparative |
| L | 0.006 | 0.34 | 0.42 | 0.018 | 0.001 | 20.17 | 0.053 | <0.01* | 4.99 | 0.0066 | | |
| M | 0.004 | 0.31 | 0.43 | 0.021 | 0.001 | 20.26 | 0.002* | 0.060 | 5.06 | 0.0089 | | |
| N | 0.006 | 0.35 | 0.48 | 0.015 | 0.002 | 20.71 | 0.051 | 0.060 | 5.03 | 0.0071 | Mo = 0.9 | This |
| O | 0.006 | 1.41 | 0.04 | 0.018 | 0.001 | 20.11 | 0.048 | 0.052 | 4.91 | 0.0060 | | Invention |
| P | 0.007 | 0.05 | 1.55 | 0.020 | 0.003 | 20.09 | 0.049 | 0.053 | 4.89 | 0.0079 | | |
| Q | 0.006 | 1.30 | 1.41 | 0.015 | 0.001 | 20.21 | 0.045 | 0.049 | 5.13 | 0.0058 | Mo = 1.2 | |

Note:
*Outside the range of the present invention.

TABLE 2

| Steel | Hot Rolling Conditions Heating Temp. (°C.) | Finishing Temp. (°C.) | Cooling Rate (°C./sec) | Coiling Temp. (°C.) | Transition Temp. (°C.) | Warm Rolling | Remarks |
|---|---|---|---|---|---|---|---|
| A | 1200 | 830 | 20 | 370 | 75 | ∘ | This |
| B | 1200 | 835 | 20 | 380 | 70 | ∘ | Invention |
| C | 1200 | 845 | 21 | 400 | 80 | ∘ | |
| D | 1200 | 840 | 23 | 355 | 65 | ∘ | |
| E | 1200 | 830 | 20 | 385 | 85 | ∘ | |
| F | 1200 | 840 | 21 | 370 | 80 | ∘ | |
| G | 1200 | 845 | 21 | 380 | 70 | ∘ | |
| H | 1200 | 850 | 23 | 340 | 90 | ∘ | |
| I | 1200 | 835 | 22 | 320 | 85 | ∘ | |
| J | 1200 | 845 | 21 | 365 | 80 | ∘ | |
| A | 1200 | 845 | 23 | 541* | 120 | x | Comparative |
| | 1200 | 840 | 8* | 395 | 110 | x | |
| C | 1200 | 835 | 40 | 780* | 140 | x | |
| E | 1200 | 845 | 30 | 620* | 150 | x | |
| G | 1200 | 840 | 45 | 750* | 145 | x | |
| | 1200 | 830 | 5* | 360 | 135 | x | |
| J | 1200 | 840 | 22 | 550* | 125 | x | |
| K* | 1200 | 835 | 39 | 640* | 130 | x | |
| L* | 1200 | 840 | 45 | 750* | 145 | x | |
| M* | 1200 | 835 | 20 | 400 | 120 | x | |
| N | 1200 | 860 | 30 | 390 | 60 | ∘ | This |
| O | 1200 | 865 | 30 | 380 | 85 | ∘ | Invention |
| P | 1200 | 865 | 22 | 380 | 85 | ∘ | |
| Q | 1200 | 865 | 25 | 380 | 90 | ∘ | |

Note:
*Outside the range of the present invention.
Warm Rolling-
∘: possible,
x: impossible

TABLE 3

| Steel | Hot Rolling Conditions: Heating Temp. (°C.) | Finishing Temp. (°C.) | Cooling Rate (°C./sec) | Coiling Temp. (°C.) | Annealing Temp. (°C.) | Transition Temp. (°C.) | Warm Rolling |
|---|---|---|---|---|---|---|---|
| A | 1200 | 830 | 20 | 370 | 900 | 75 | ○ |
| | " | " | " | " | 800* | 110 | x |
| | " | " | " | " | 700* | 120 | x |
| | " | " | " | " | — | 75 | ○ |

Note:
*Outside the range of the present invention.
Warm Rolling-
○: possible,
x: impossible

TABLE 4

| Thickness of Al Deposition (μm) | Oxidation Time (hr): 96 | 120 | 144 | 192 | 240 | 288 | 350 |
|---|---|---|---|---|---|---|---|
| 0* | ○ | x | — | — | — | — | — |
| 0.1* | ○ | Δ | x | — | — | — | — |
| 0.2 | ○ | ○ | ○ | ○ | Δ | x | — |
| 1 | ○ | ○ | ○ | ○ | ○ | ○ | Δ |
| 2 | ○ | ○ | ○ | ○ | ○ | ○ | ○ |
| 3 | ○ | ○ | ○ | ○ | ○ | ○ | ○ |
| 4 | ○ | ○ | ○ | ○ | ○ | ○ | ○ |
| 5* | | | — | — | — | — | — |

Note:
*Outside the range of the present invention.

What is claimed:

1. A hot-rolled plate of a ferritic stainless steel having improved toughness as well as workability, which consists essentially of:

C: not larger than 0.020%,
N: not larger than 0.020%,
C(%)+N(%): not larger than 0.030%,
Cr: 9.0–35.0%,
Al: 3.0–8.0%,
Y: 0.010–0.10%, Ti: 0.010–0.10%,
one or more of Si: larger than 1.0% but not larger than 5.0%, and Mn: larger than 1.0% but not larger than 2.0%,
Mo: 0–5.0%,
Fe and incidental impurities: balance.

2. A hot-rolled plate of a ferritic stainless steel as set forth in claim 1 wherein the Mo content of the steel is 0.5–5.0%.

3. A hot-rolled plate of a ferritic stainless steel as set forth in claim 1 wherein the C content of the steel is not larger than 0.010% and the N content is not larger than 0.010%.

4. A hot-rolled plate of a ferritic stainless steel as set forth in claim 1 wherein the Cr content of the steel is 18–25%.

5. A hot-rolled plate of a ferritic stainless steel as set forth in claim 1 wherein the Al content of the steel is 3.0–6.0%.

6. A foil of a ferritic stainless steel having improved heat resistance, which has an Al vapor deposition on both sides with the thickness of the deposition being 0.2–4.0 micrometers, the ferritic stainless steel consisting essentially of:

C: not larger than 0.020%,
N: not larger than 0.020%,
C(%)+N(%): not larger than 0.030%,
Cr: 9.0–35.0%,
Al: 3.0–8.0%,
Y: 0.010–0.10%, Ti: 0.010–0.10%,
one or more of Si: larger than 1.0% but not larger than 5.0%, and Mn: larger than 1.0% but not larger than 2.0%,
Mo: 0–5.0%,
Fe and incidental impurities: balance.

7. A foil of a ferritic stainless steel as set forth in claim 6 wherein the Mo content of the steel is 0.5–5.0%.

8. A process for manufacturing a hot-rolled plate of a ferritic stainless steel, which comprises the steps of hot rolling a ferritic stainless steel consisting essentially of:

C: not larger than 0.020%,
Si: not larger than 1.0%,
Mn: not larger than 1.0%,
N: not larger than 0.020%,
C(%)+N(%): not larger than 0.030%,
Cr: 9.0–35.0%,
Al: 3.0–8.0%,
Y: 0.010–0.10%,
Ti: 0.010–0.10%,
Mo: 0–5.0%,
Fe and incidental impurities: balance, cooling the hot-rolled steel plate at a cooling rate of 20° C./sec. or higher immediately after hot rolling, and coiling the hot-rolled steel plate at a temperature of 400° C. or lower.

9. A process for manufacturing a hot-rolled plate of a ferritic stainless steel as set forth in claim 8 wherein the Mo content of the steel is 0.5–5.0%.

10. A process for manufacturing a hot-rolled plate of a ferritic stainless steel as set forth in claim 8 wherein the hot rolling is carried out with a heating temperature of 1100°–1250° C. and a finishing temperature of 800°–1000° C.

11. A process for manufacturing a hot-rolled plate of a ferritic stainless steel as set forth in claim 8 wherein the cooling rate is 20°–30° C./sec.

12. A process for manufacturing a hot-rolled plate of a ferritic stainless steel as set forth in claim 8 wherein the process further comprises the step of annealing the hot-rolled steel plate at a temperature of 900°–1050° C.

13. A process for manufacturing a hot-rolled plate of a ferritic stainless steel, which comprises the steps of hot rolling a ferritic stainless steel consisting essentially of:

C: not larger than 0.020%,
N: not larger than 0.020%,
C(%)+N(%): not larger than 0.030%,
Cr: 9.0–35.0%,
Al: 3.0–8.0%,
Y: 0.010–0.10%,
Ti: 0.010–0.10%,
one or more of Si: larger than 1.0% but not larger than 5.0%, and Mn: larger than 1.0% but not larger than 2.0%,
Mo: 0–5.0%, Fe and incidental impurities: balance.

14. A process for manufacturing a hot-rolled plate of a ferritic stainless steel as set forth in claim 13 wherein the Mo content of the steel is 0.5–5.0%.

15. A process for manufacturing a hot-rolled plate of a ferritic stainless steel as set forth in claim 13 wherein the hot rolling is carried out with a heating temperature of 1100°–1250° C. and a finishing temperature of 800°–1000° C.

16. A process for manufacturing a hot-rolled plate of a ferritic stainless steel as set forth in claim 13 wherein the cooling rate is 20°–30° C./sec.

17. A process for manufacturing a hot-rolled plate of a ferritic stainless steel as set forth in claim 13 wherein the process further comprises the step of annealing the hot-rolled steel plate at a temperature of 900°–1050° C.

18. A process for manufacturing a foil of a ferritic stainless steel which comprises the steps of hot rolling a ferritic stainless steel which consists essentially of:

C: not larger than 0.020%,
Si: not larger than 1.0%,
Mn: not larger than 1.0%,
N: not larger than 0.020%,
C(%)+N(%): not larger than 0.030%,
Cr: 9.0–35.0%,
Al: 3.0–8.0%,
Y: 0.010–0.10%,
Ti: 0.010–0.10%,
Mo: 0–5.0%
Fe and incidental impurities: balance, cooling the hot-rolled steel plate at a cooling rate of 20° C./sec. or higher immediately after hot rolling, coiling the hot-rolled steel plate at a temperature of 400° C. or lower, cold rolling the resulting hot-rolled steel sheet until the thickness thereof reaches 50 micrometers or less, and applying Al vaporization to the thus-obtained foil to a thickness of 0.2–4.0 micrometers.

19. A process for manufacturing a foil of a ferritic stainless steel which comprises the steps of hot rolling a ferritic stainless steel which consists essentially of:

C: not larger than 0.020%,
N: not larger than 0.020%,
C(%)+N(%): not larger than 0.030%,
Cr: 9.0–35.0%,
Al: 3.0–8.0%,
Y: 0.010–0.10%,
Ti: 0.010–0.10%, one or more of Si: larger than 1.0% but not larger than 5.0%, and Mn: larger than 1.0% but not larger than 2.0%, Mo: 0–5.0%,
Fe and incidental impurities: balance.

* * * * *